US006570961B2

(12) United States Patent
Noonan et al.

(10) Patent No.: US 6,570,961 B2
(45) Date of Patent: May 27, 2003

(54) X-RAY SOURCE BEARING HOUSING ASSEMBLY

(75) Inventors: Daniel John Noonan, Middle Grove, NY (US); Mark Ernest Vermilyea, Niskayuna, NY (US); Antonio Alberto Mogro-Campero, Niskayuna, NY (US); Liangfeng Xu, Irving, TX (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/682,126

(22) Filed: Jul. 25, 2001

(65) Prior Publication Data

US 2003/0021378 A1 Jan. 30, 2003

(51) Int. Cl.[7] ..... H01J 35/10

(52) U.S. Cl. ..... 378/132; 378/130; 378/141

(58) Field of Search ..... 378/132, 119, 378/125, 127, 130, 141, 143, 144

(56) References Cited

U.S. PATENT DOCUMENTS

| | | | | | |
|---|---|---|---|---|---|
| 4,097,760 | A | * | 6/1978 | Cinelli | 378/133 |
| 4,326,144 | A | * | 4/1982 | Appelt | 378/132 |
| 4,569,070 | A | | 2/1986 | Schubert et al. | 378/132 |
| 5,991,361 | A | | 11/1999 | Bhatt | 378/132 |
| 6,011,829 | A | | 1/2000 | Panasik | 378/132 |
| 6,041,100 | A | * | 3/2000 | Miller et al. | 378/141 |
| 6,249,569 | B1 | * | 6/2001 | Price et al. | 378/141 |

* cited by examiner

*Primary Examiner*—Drew A. Dunn
(74) *Attorney, Agent, or Firm*—Patrick K. Patnode; Christian G. Cabou

(57) ABSTRACT

X-ray source bearing assemblies are described herein. In an exemplary embodiment, an x-ray source includes a target anode, a rotor shaft coupled to the target anode, and a motor coupled to the rotor shaft at an end of the shaft opposite the target anode. The bearing housing, in the exemplary embodiment, includes a rotor bore, the rotor shaft extending through said rotor bore and supported therein by a plurality bearings. The housing and the shaft form a cooling medium pool so that as the shaft rotates, a cooling medium in the pool is radially displaced.

7 Claims, 5 Drawing Sheets

X-RAY SOURCE BEARING HOUSING ASSEMBLY

BACKGROUND OF INVENTION

This invention relates generally to x-ray sources, and more particularly to an x-ray source bearing assembly for facilitating heat dissipation.

In medical x-ray imaging, an x-ray source is utilized for generating x-ray beams that pass through an object being imaged. More specifically, an x-ray source projects a fan-shaped beam which is collimated to lie within an X-Y plane of a Cartesian coordinate system and generally referred to as an "imaging plane". The x-ray beam passes through an object being imaged, such as a patient. The beam, after being attenuated by the object, impinges upon an array of radiation detectors. The intensity of the attenuated beam radiation received at a detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile.

A typical x-ray source includes an x-ray tube which emits an x-ray beam at a focal spot. Known x-ray tubes include a cathode aligned with a rotating target anode. An electron beam generated at a cathode emitter is directed towards the anode and forms a focal spot on an anode surface. As a result, x-ray beams are emitted from the anode.

The target anode is rotated by a rotor shaft coupled to a motor. Specifically, the rotor shaft extends from the motor, through a bearing housing, to the anode. The shaft is supported by bearings contained in the bearing housing, and rotates relative to the bearing housing.

During operation, the motor rotates, or drives, the rotor shaft to rotate, and the target anode rotates with the shaft. Rotation of the shaft on the bearings results in heat being generated in the bearing housing. The heat generated by the rotating shaft should be dissipated in order to avoid failure of the x-ray tube bearings.

SUMMARY OF INVENTION

In one aspect, an x-ray source including a cooling medium pool for cooling rotor shaft bearings is provided. In an exemplary embodiment, the x-ray source includes a target anode, a rotor shaft coupled to the target anode, and a motor coupled to the rotor shaft at an end of the shaft opposite the target anode. The source further includes a bearing housing including a rotor bore. The rotor shaft extends through the rotor bore and is supported therein by a plurality of bearings. The bearing housing and the rotor shaft form a cooling medium pool so that as the rotor shaft rotates, a cooling medium in the cooling medium pool is radially displaced.

In another aspect, a method for assembling a rotor shaft and a bearing housing is provided. The bearing housing has a rotor bore therethough and includes a first bearing containment section and a second bearing containment section. The method includes the steps of locating the first bearing containment section so that the rotor shaft extends therethrough and so that an outer race of the first bearing containment section aligns with an inner race of the rotor shaft, and locating the second bearing containment section so that the rotor shaft extends therethrough and so that an end section of the second bearing containment section mates with the first section, and welding the first bearing containment section to the second bearing containment section.

In yet another aspect, a bearing housing and rotor shaft is provided The bearing housing includes a rotor bore, and the rotor shaft extends through the rotor bore and is supported therein by a plurality bearings. The bearing housing and the rotor shaft form a cooling medium pool so that as the shaft rotates, a cooling medium in the pool is radially displaced.

DETAILED DESCRIPTION

Although specific embodiments of a bearing housing and rotor assembly, sometimes referred to herein as a bearing housing assembly, are described herein in the context of an exemplary x-ray source, such assembly is not limited to practice with such exemplary x-ray source and can be utilized in connection with other x-ray sources. In addition, the exemplary x-ray source is sometimes described in the context of a computed tomography (CT) machine, and more specifically, a third generation CT machine. The bearing housing and rotor assembly can, however, be utilized in connection with other types of x-ray machines. Therefore, the description of the bearing housing and rotor assembly in connection with an x-ray source for a CT machine is exemplary only.

Figure 1:
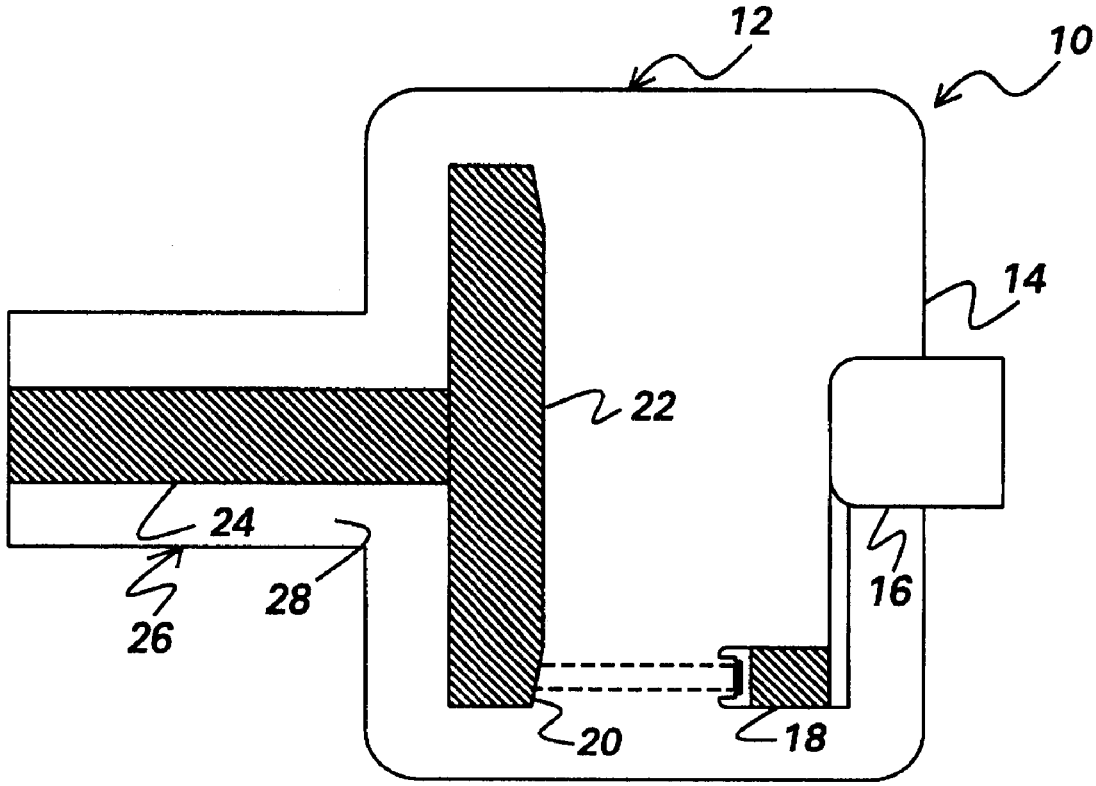
FIG. 1 is a schematic illustration of an x-ray tube.

FIG. 1 is a schematic illustration of a typical x-ray source 10, sometimes referred to as an x-ray tube. Tube 10 includes a glass envelope 12 which at one end 14 has a cathode support 16 sealed into it. The electron emissive filament of a cathode is mounted on insulators located in a focusing cup 18 which focuses an electron beam against a beveled annular focal track area 20 of a rotating x-ray target 22. Target 22 is supported on a rotor shaft 24 that extends from a bearing housing and rotor assembly 26.

During operation, a rotating magnetic field induced in the motor rotor causes rotor shaft 24 to rotate. In addition, an electron beam is emitted from cathode cup 18 and is focused on beveled annular focal track area 20 of x-ray target 22. The electrons of beam collide with anode 22 and as a result, x-ray beams are generated. A focal spot is formed on the anode surface by the electron beam, and the x-ray beams emanate from the focal spot. The x-ray beams pass through a window in glass envelope 12 and pass through an object being imaged, such as a patient.

Rotor shaft 24 rotates on bearings contained within a bearing housing 28. If the bearings deteriorate, then shaft 24 may rotate at a speed slower than an expected speed. Such deterioration also may result in undesired movement, or wobbling, of target anode 22. Bearing deterioration therefore can adversely impact the characteristics of the x-ray beam emitted from x-ray source 10.

Bearing deterioration can be caused, for example, by failure to dissipate heat generated as rotor shaft 24 rotates on the bearings. To facilitate such heat dissipation, an oil cooling path typically is provided within bearing housing 28 so that oil flows axially relative to shaft 24. Heat is transferred to, and dissipated by, the axially flowing oil. While such axial flow paths have generally provided acceptable results, it would be beneficial to further enhance bearing cooling to extend bearing life.

Figure 2:
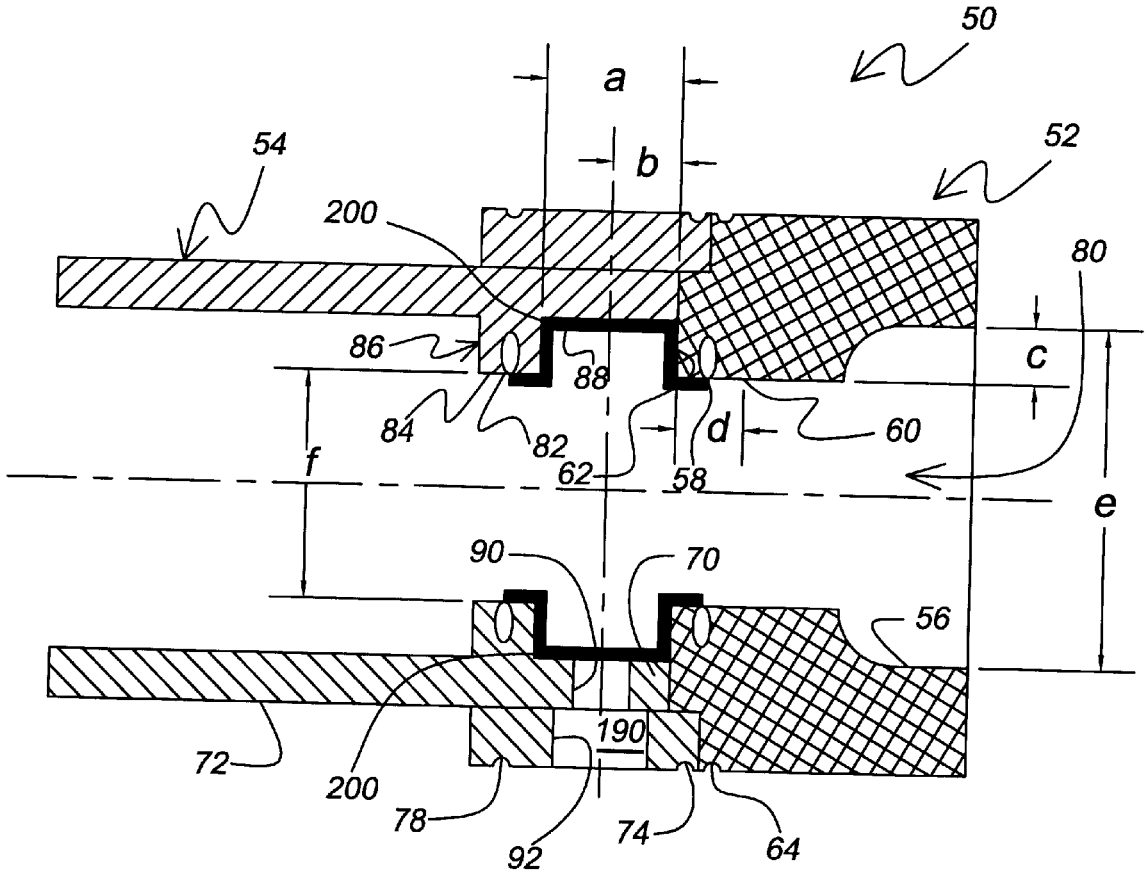
FIG. 2 is a cross-sectional side view of a portion of a bearing housing.

FIG. 2 is a cross-sectional side view of a portion of an exemplary embodiment of a bearing housing 50. Bearing housing 50 is generally cylindrical and includes a first bearing containment section 52 and a second pool containment section 54. First bearing containment section 52 includes a bearing outer race 56 and a first section sealing cavity 58 located at an end 60 of a flange 62. First section sealing cavity 58, as described below in more detail, captures incidental leakage of a coolant medium 190 from a cooling medium pool 200 as described below in more detail. First section sealing cavity 58, in the exemplary embodiment, is 2 mm ×2 mm. First bearing containment section 52 also includes an annular weld preparation groove 64 in an outer surface 66.

Second pool containment section 54 includes an end section 70 that mates with first containment section flange 62. Second section 54 also includes, in an outer surface 72, a first annular weld preparation groove 74 near an end 76 and a second annular weld preparation groove 78 spaced from first groove 74.

When end section 70 is mated with first containment section flange 62 as shown in FIG. 2 and as described in more detail below, first and second sections 52 and 54 are welded together to form bearing housing 50. Weld preparation grooves 64, 74 and 78 facilitate forming a reliable weld. A rotor bore 80 extends through housing 50 and is sized to receive a rotor shaft coupled at one end to a motor and at its other end to a target anode.

Second section 54 also includes a second section sealing cavity 82 located at an end 84 of a flange 86. Second section sealing cavity 82, in the exemplary embodiment, is 2 mm ×2 mm. A cooling medium containment wall 88 is radially outward relative to second section sealing cavity 82. More specifically, first section sealing cavity 58 and second section sealing cavity 82 define perimeters of the cooling medium pool 200. In addition, cooling medium containment wall 88 defines a radially outermost perimeter of the cooling medium pool 200. As described in more detail below, first section sealing cavity 58 and second section sealing cavity 82 cooperate with annular flanges on a rotor shaft to facilitate preventing leakage of the cooling medium 190 from the cooling medium pool 200.

Second section 54 further includes an opening 90 for facilitating the injection of a cooling medium 190 into the cooling medium pool 200, A counter-bore 92 adjacent opening 90 is provided to facilitate securing a plug within opening 90 to prevent the leakage of the cooling medium 190 [coolant] from the cooling medium pool 200. The plug is removable so that additional cooling medium 190 can be placed in the cooling medium pool 200.

Figure 3:
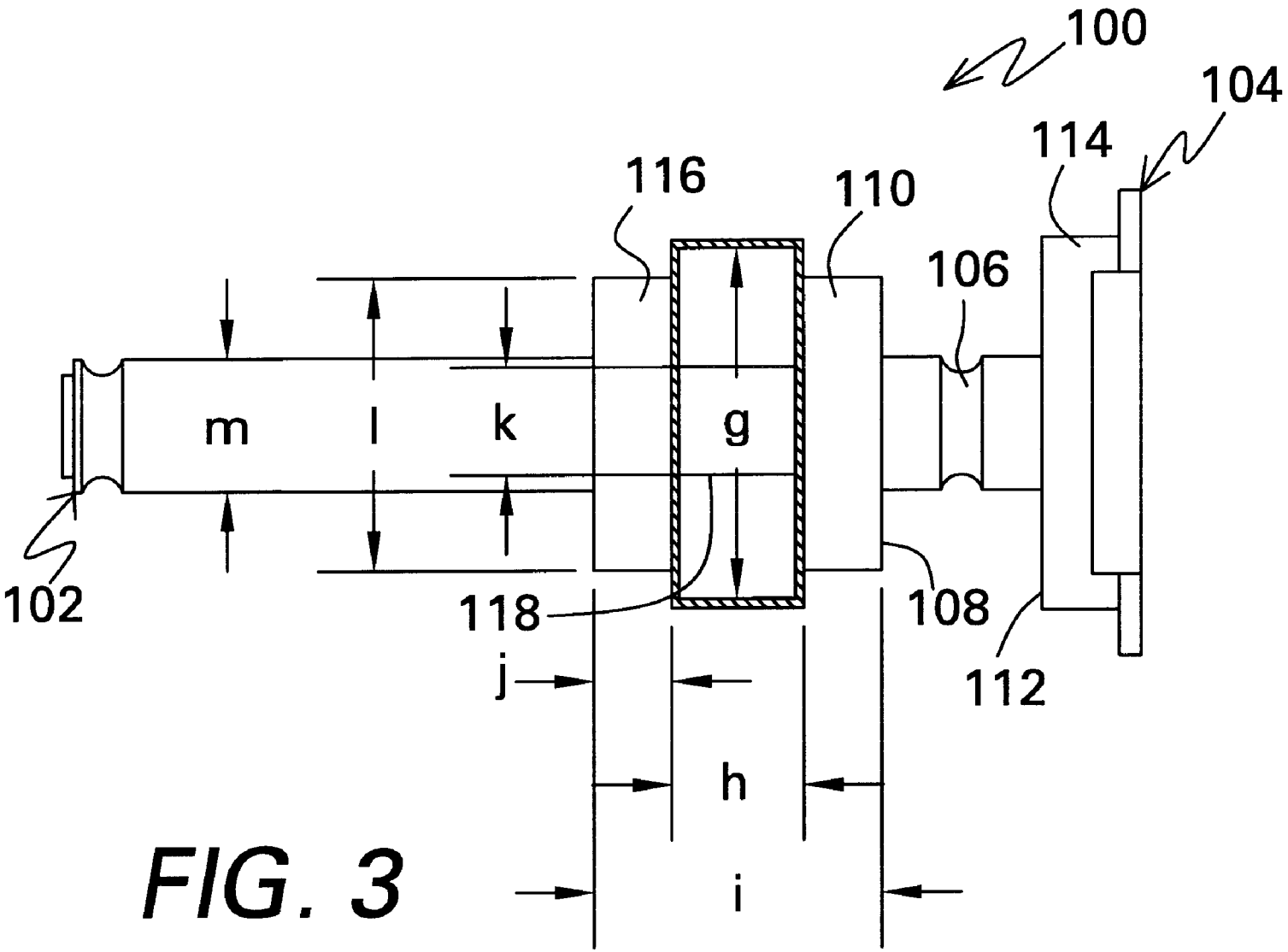
FIG. 3 is a side view of a rotor shaft.

Referring to FIG. 3, which is a side view of an exemplary rotor shaft 100, shaft 100 is sized to be inserted within rotor bore 80 of housing 50. One end 102 of rotor shaft 100 is configured to be coupled to a motor, i.e., a motor coupling, and another end 104 of rotor shaft 100 is configured to be coupled to a target anode, i.e., a target anode coupling. The specific configuration of ends 102 and 104 is dictated by the coupling arrangements utilized for the motor and the target anode.

Figure 6:
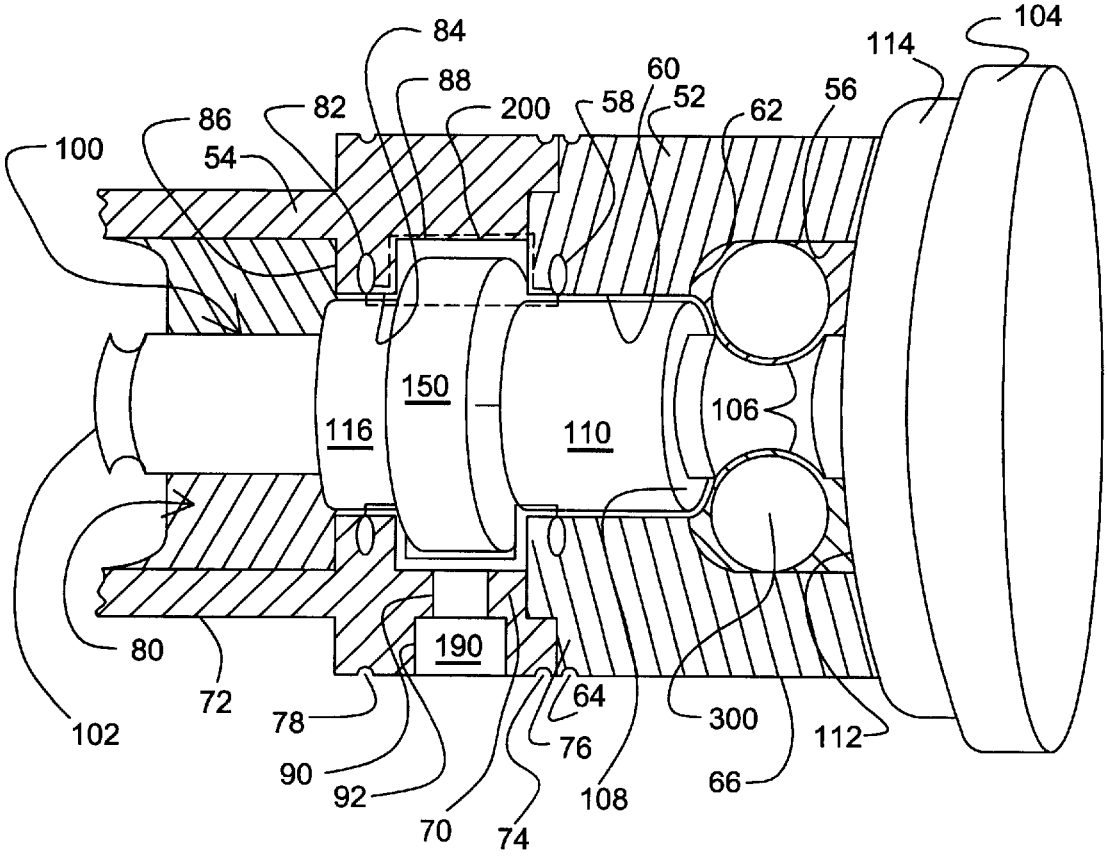
FIG. 6 is a partial cross section of the assembly of the rotor shaft disposed in the bearing housing.

Rotor shaft 100 of FIG. 6 also includes an inner race 106 and a flange 110. A wall 108 of flange 110 and a wall 112 of target anode coupling 114 contain bearings 300 within the inner race 106. As explained above, the bearing housing 50 includes outer race 56, and multiple bearings 300 are trapped between the outer race 56 and the inner race 106 when rotor shaft 100 and bearing housing 50 are assembled.

Rotor shaft 100 further includes annular flange 116, spaced apart from flange 110 with a radially inward containment wall 118 extending there between. Each flange 110 and 116 aligns with one of cavities 58 and 82, and together with one of respective cavities 58 and 82, forms a barrier to prevent the cooling medium 190 from leaking out of the cooling medium pool 200.

Figure 5:
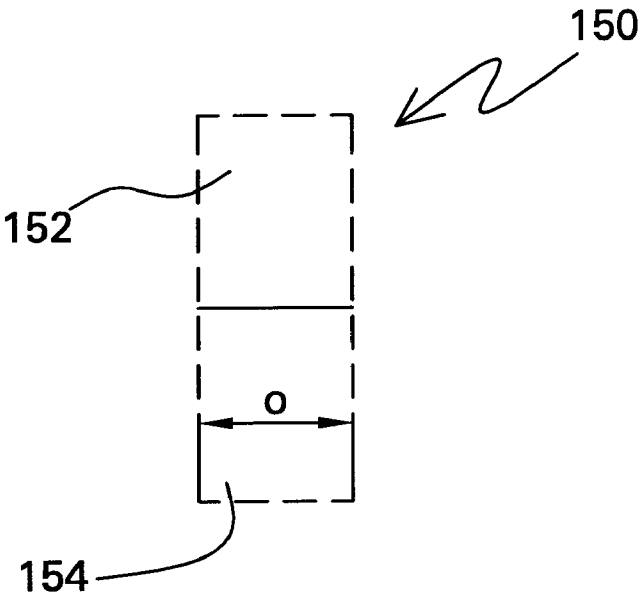
FIG. 5 is a side view of the rotor collar shown in FIG. 4.
Figure 4:
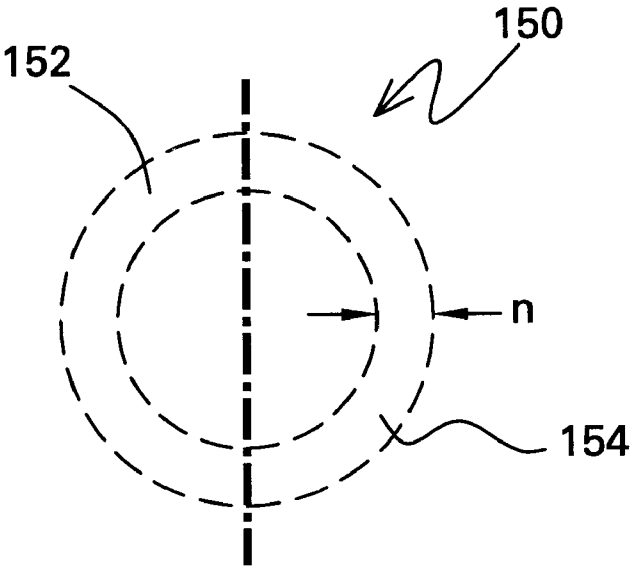
FIG. 4 is a front view of a rotor collar.

FIG. 4 is a front view of a rotor collar 150, and FIG. 5 is a side view of collar 150. Collar 150 includes a first section 152 and a second section 154, and is sized to fit between first and second flanges 110 and 116 of rotor shaft 100. Collar 150 facilitates maintaining the cooling medium 190 within the cooling medium pool 200.

To assemble rotor shaft 100 of FIG. 6 and bearing housing 50, first bearing containment section 52 of bearing housing 50 is pushed over rotor shaft 100 so that outer race 56 is positioned over inner race 106, and so that first section sealing cavity 58 is aligned with flange 110. Ball bearings 300 are located within, and trapped in the space between outer race 56 and inner race 106.

End 102 of rotor shaft 100 is coupled to a motor and rotor shaft end 104 is coupled to a target anode. A cooling medium 190 is then injected into the cooling medium pool 200 via opening 90 Exemplary cooling mediums include liquid metal (e.g., gallium indium tin) and oil. Once the cooling medium pool 200 is full, a plug is then inserted into opening 90 to prevent leakage.

End 102 of rotor shaft 100 is coupled to a motor and rotor shaft end 104 is coupled to a target anode. A cooling medium is then injected into the pool via opening 90. Exemplary cooling mediums include liquid metal (e.g., gallium indium tin) and oil. Once the pool is full, a plug is then inserted into opening 90 to prevent leakage.

Bearing housing 50 and shaft 100 are fabricated from, for example, hardened steel (e.g., Rockwell 60 62 hardened). By way of example and not limitation, and with respect to the specific embodiment illustrated in FIGS. 2, 3, and 4, the following dimensions (in mm) correspond to the dimensions indicated by corresponding letters in the figures.

a 9.2 +/−0.001
b 4.6
c 4.69
d 4.9
e 31.98 +/−0.01
f 22.6 +/−0.1
g 28.6
h 9
i 18
j 4.5
k 18.0
l 22.50 +/−0.003
m 20.04 min
n 5.3
o 9.0

During operation, rotor shaft 100 rotates relative to housing 50. The bearings 300 support rotor shaft 100 and facilitate such relative rotation. Heat generated by the bearings 300 is transferred to the walls of bearing housing 50 and rotor shaft 100. Because the cooling medium 190 is in flow communication with rotor shaft 100, the cooling medium 190 dissipates heat from rotor shaft 100. In addition, the cooling medium 190 is displaced within and towards the perimeter of the cooling medium pool 200 by the centrifugal forces generated by rotating shaft 100. The cooling medium 190; therefore, is forced against the cooling medium containment wall 88, which facilitates heat transfer from the cooling medium 190 to the cooling medium containment wall 88.

FIG. 6 provides a partial cross sectional view of the bearing housing/rotor assembly 26 in one embodiment of the present invention. In one particular embodiment of the present invention, FIG. 6 provides a view of the rotor shaft 100 of Fig, 3 disposed in the rotor bore 80 of FIG. 2 of the bearing housing 50. The interaction of the flange 110, the annular flange 116, the rotor collar 150 that are disposed on the rotor shaft 100 to the first section sealing cavity 58, the second section sealing cavity 82, and the cooling medium containment wall 88 that are disposed on the bearing housing 50, which forms the perimeter of the cooling medium pool 200 is discussed above with regard to FIGS. 2 and 3 and is presented in one embodiment of the present invention in FIG. 6. The cooling medium 190 is depicted as being disposed in the cooling medium pool 200 as discussed above with regards to FIG. 2. Additionally, FIG. 6 depicts the interaction between the bearing housing 50, the bearings 300, and the rotor shaft 100 as discussed above with regards to FIGS. 2–3.

The above described assembly of the bearing housing 50 and the rotor shaft 100 facilitates dissipating heat generated by the bearings 300. As explained above, improving heat dissipation can lead to extended bearing life as well as consistent operation of the x-ray source 10.

While the invention has been described in terms of various specific embodiments, those skilled in the art will recognize that the invention can be practiced with modification within the spirit and scope of the claims.

What is claimed is:

1. An x-ray source, comprising:

a target anode;

a rotor shaft coupled to said target anode;

a motor coupled to said rotor shaft at an end of said rotor shaft opposite said target anode; and a bearing housing comprising a rotor bore, said rotor shaft extending through said rotor bore and supported therein by a plurality of bearings, said bearing housing and said rotor shaft forming a cooling medium pool so that as said rotor shaft rotates, a cooling medium in said cooling medium pool is radially displaced, said bearing housing being generally cylindrical and comprising a first bearing containment section and a second pool containment section, said first bearing containment section comprising a bearing outer race surface and a first section sealing cavity being located at an end of a flange, said second pool containment section comprising an end section, a second section sealing cavity, and a cooling medium containment wall, said end section being disposed to mate with said first bearing containment section, said cooling medium containment wall being disposed radially outward relative to said second section sealing cavity, said first section sealing cavity and said second section sealing cavity defining perimeters of said cooling medium pool, and said cooling medium containment wall defining a radially outermost perimeter of cooling medium pool, said rotor shaft further comprises a flange and an annular flange, said flange and said annular flange being spaced apart, and a collar being disposed to extend therebetween, said flange being aligned with said first section sealing cavity, said annular flange being aligned with said second section sealing cavity, and said collar being aligned with said cooling medium containment wall.

2. The x-ray source according to claim 1, wherein said rotor shaft comprises an inner race, and said bearing housing comprises an outer race, and a plurality of bearings are trapped between said outer race and said inner race.

3. The x-ray source according to claim 1, wherein said rotor collar comprises a first section and a second section, wherein both said first section and said second section are sized to fit between said flange and said annular flange.

4. The x-ray source according to claim 3, wherein said first section and said second section are disposed to be fastened together.

5. An assembly comprising:

a bearing housing; and a rotor shaft;

said bearing housing comprising a rotor bore, said rotor shaft extending through said rotor bore and supported therein by a plurality of bearings, said bearing housing and said rotor shaft forming a cooling medium pool so that as said rotor shaft rotates, a cooling medium being disposed in said cooling medium pool is radially displaced.

said bearing housing being generally cylindrical and comprising a first bearing containment section and a second pool containment section, said first bearing containment section comprising a bearing outer race surface and a first section sealing cavity being disposed at an end of a flange, said second pool containment section comprising a second section sealing cavity, a cooling medium containment wall, and an end section being disposed to mate with said first bearing containment section, said cooling medium containment wall being disposed radially outward relative to said second section sealing cavity, said first section sealing cavity and said second section sealing cavity defining perimeters of said cooling medium pool, and said cooling medium containment wall defining a radially outermost perimeter of cooling medium pool, said rotor shaft further comprising a flange and an annular flange, said flange and said annular flange being spaced apart, and a collar being disposed to extend therebetween, said flange being aligned with said first section sealing cavity, said annular flange being aligned with said second section sealing cavity, and said collar being aligned with said cooling medium containment wall.

6. The assembly according to claim 5, wherein said rotor shaft comprises an inner race, and said bearing housing comprises an outer race, and a plurality of bearings are trapped between said outer race and said inner race.

7. The assembly according to claim 5, wherein said rotor collar comprises a first section and a second section, wherein both said first section and said second section are sized to fit between said flange and said annular flange.

* * * * *